US008611798B2

(12) United States Patent
Ozaki et al.

(10) Patent No.: US 8,611,798 B2
(45) Date of Patent: Dec. 17, 2013

(54) DEVELOPING DEVICE AND IMAGE FORMING APPARATUS

(75) Inventors: Yoshifumi Ozaki, Ebina (JP); Akihiko Noda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 208 days.

(21) Appl. No.: 12/706,299

(22) Filed: Feb. 16, 2010

(65) Prior Publication Data

US 2011/0069998 A1 Mar. 24, 2011

(30) Foreign Application Priority Data

Sep. 18, 2009 (JP) ..... 2009-218023

(51) Int. Cl.
*G03G 15/08* (2006.01)

(52) U.S. Cl.
USPC ..... 399/269; 399/229; 399/277

(58) Field of Classification Search
USPC ..... 399/53, 148, 226, 229, 269, 277
See application file for complete search history.

(56) References Cited

U.S. PATENT DOCUMENTS

| | | | | |
|---|---|---|---|---|
| 3,167,455 | A * | 1/1965 | Laben et al. | 399/234 |
| 3,575,139 | A * | 4/1971 | Nuzum | 399/230 |
| 3,638,614 | A * | 2/1972 | Young et al. | 399/269 |
| 3,640,248 | A * | 2/1972 | Nielander | 399/269 |
| 5,995,790 | A * | 11/1999 | Takeda | 399/274 |
| 6,091,925 | A * | 7/2000 | Sugimoto et al. | 399/327 |
| 7,941,079 | B2 * | 5/2011 | Hatano | 399/269 |
| 2002/0044797 | A1 * | 4/2002 | Itoh | 399/269 |
| 2002/0054773 | A1 * | 5/2002 | Shirai | 399/269 |
| 2002/0181974 | A1 * | 12/2002 | Sekiguchi | 399/269 |
| 2003/0143001 | A1 * | 7/2003 | Mitsuya et al. | 399/269 |
| 2007/0280744 | A1 * | 12/2007 | Kubo et al. | 399/269 |
| 2009/0123194 | A1 * | 5/2009 | Hatano | 399/285 |

FOREIGN PATENT DOCUMENTS

| | | | |
|---|---|---|---|
| JP | 08-022193 | A | 1/1996 |
| JP | 9-197827 | A | 7/1997 |
| JP | 2002-62731 | A | 2/2002 |
| JP | 2003-215909 | A | 7/2003 |
| JP | 2007322565 | A * | 12/2007 |
| JP | 2009-116261 | A | 5/2009 |

OTHER PUBLICATIONS

Notification of the First Office Action dated Jul. 3, 2013 issued by the State Intellectual Properly Office of People's Republic of China in Chinese application No. 201010138366.7.
Communication from the Japanese Patent Office dated Aug. 20, 2013, issued in Japanese application No. 2009-218023.

* cited by examiner

*Primary Examiner* — David Gray
*Assistant Examiner* — Francis Gray
(74) *Attorney, Agent, or Firm* — Sughrue Mion, PLLC

(57) ABSTRACT

A developing device includes: a developing housing in which a developer is to be contained; a first developer carrier that is placed opposedly to an image carrier which is rotated while a latent image is formed on a surface of the image carrier, that is supported by the developing housing, and that is rotated while holding the developer on a surface of the first developer carrier; a second developer carrier that is supported movably with respect to the developing housing, that is opposed to the image carrier on an upstream or downstream side of the first developer carrier in a rotation direction of the image carrier, and that is rotated while holding the developer on a surface of the second developer carrier; and a coupling defined herein.

19 Claims, 6 Drawing Sheets

51 (52)
53
Ga
Gb
N2
Q2a
Q2b
S11
21d
31d
64
PR
01
02
Z
X
Y
(-X)
(-Y)
(-Z)

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2009-218023 filed on Sep. 18, 2009.

BACKGROUND

Technical Field

The present invention relates to a developing device and an image forming apparatus.

SUMMARY

According to an aspect of the invention, a developing device includes: a developing housing in which a developer is to be contained; a first developer carrier which is placed opposedly to an image carrier that is rotated while a latent image is formed on a surface, which is supported by the developing housing, and which is rotated while holding the developer on a surface; a second developer carrier which is supported movably with respect to the developing housing, which is opposed to the image carrier on an upstream or downstream side of the first developer carrier in a rotation direction of the image carrier, and which is rotated while holding the developer on a surface; and a coupling member which couples the first developer carrier with the second developer carrier, and which supports the second developer carrier in a rotatable manner with respect to the first developer carrier.

BRIEF DESCRIPTION OF THE DRAWINGS

Exemplary embodiments of the present invention will be described in detail based on the following figures, wherein:

FIG. 2A is a sectional view of main portions, and FIG. 2B is a side view as viewing the developing device from the front side;

FIG. 5A is a diagram of a state which is a design objective, FIG. 5B is a diagram of a state in which the configuration of Example 1 is employed and the developing device is upwardly deviated from the state of FIG. 5A, and FIG. 5C is a diagram of a state in which, in the conventional configuration, the developing device is upwardly deviated from the state of FIG. 5A;

FIG. 6A is a diagram of positional relationships corresponding to FIGS. 5A and 5B, and FIG. 6B is a diagram of positional relationships corresponding to FIGS. 5A and 5C.

DETAILED DESCRIPTION

Figure 1:
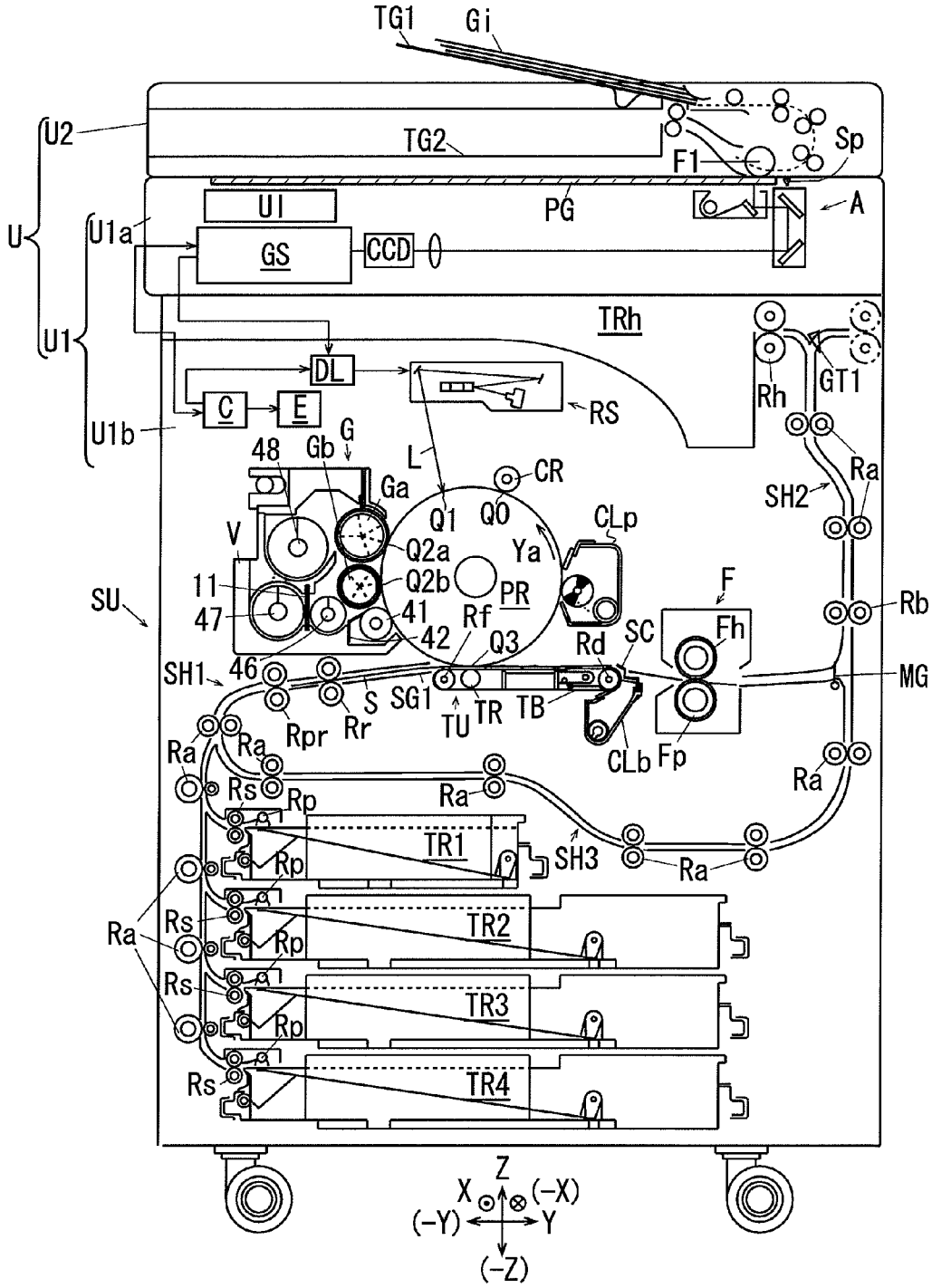
FIG. 1 is a diagram of an image forming apparatus of Example 1 of the invention.

Next, a specific example (hereinafter, referred to as example) of an exemplary embodiment of the invention will be described. However, the invention is not restricted to the following example.

In order to facilitate the understanding of the following description, the front and rear directions in the drawings are indicated as X-axis directions, the right and left directions are indicated as Y-axis directions, and the upper and lower directions are indicated as Z-axis directions. The directions or sides indicated by the arrows X, −X, Y, −Y, Z, and −Z are the front, rear, right, left, upper, and lower directions, or the front, rear, right, left, upper, and lower sides, respectively.

In the figures, the symbol in which "●" is written in "○" indicates the arrow which is directed from the rear of the sheet to the front, and that in which "×" is written in "○" indicates the arrow which is directed from the front of the sheet to the rear.

In the following description with reference to the drawings, illustrations of members other than those which are necessary in description are suitably omitted for the sake of easy understanding.

Example 1

FIG. 1 is a diagram of an image forming apparatus of Example 1 of the invention.

Referring to FIG. 1, a copier U which is an example of the image forming apparatus of Example 1 includes: an apparatus body U1 which is an example of an image recording portion, the portion having, in the upper face, a platen glass PG which is an example of a transparent document table; and an automatic document feeder U2 which is detachably attached onto the platen glass PG.

The automatic document feeder U2 has a document feed tray G1 which is an example of a document loading portion in which a plural documents Gi to be copied are stacked. The plural documents Gi which are placed on the document feed tray G1 are sequentially passed through a copy position on the platen glass PG, and then discharged to a document discharge try G2 which is an example of a document discharging portion.

The apparatus body U1 has: a user interface UI which is an example of an operation instruction inputting portion into which the operator inputs instructions; a scanner portion U1*a* which is an example of an image reading portion, and a printer portion U1*b* which is an example of an image recording portion, the scanner portion and the printer portion being sequentially placed under the platen glass PG; and an image processing portion GS which is disposed in the scanner portion U1*a* or the printer portion U1*b*.

The scanner portion U1*a* which is placed under the transparent platen glass PG in the upper face of the apparatus body U1 has an exposure system registration sensor Sp which is an example of an exposure system position detecting member which is placed at a document reading position, and an exposure optical system A.

The moving and stopping operations of the exposure optical system A are controlled by a detection signal of the exposure system registration sensor Sp, and the system is normally stopped at a home position which is an example of an image reading position, i.e., the initial position.

In the case of an automatic document transporting operation in which copying is performed while a document is automatically transported by using the automatic document feeder U2, the exposure optical system A is in a state where the system is stopped at the home position, and exposes the documents Gi which are sequentially passed through the copy position F1 on the platen glass PG.

In the case of a document manual setting operation in which copying is performed while the document Gi is manually placed on the platen glass PG by the operator, the exposure optical system A exposure-scans the document on the platen glass PG while moving.

Reflected light from the exposed document Gi is passed through the exposure optical system A to be converged on a solid-state imaging device CCD. The solid-state imaging device CCD converts the document reflected light which is converged onto the imaging plane, to an electric signal.

The image processing portion GS converts the read image signal supplied from the solid-state imaging device CCD of the scanner portion U1*a*, to a digital image write signal, and outputs the image write signal to a latent-image writing circuit DL of the image forming portion U1*b*.

The latent-image writing circuit DL outputs a latent-image writing signal corresponding to the input image data, to an exposing device RS which is an example of a latent-image forming apparatus.

A photosensitive member drum PR which is an example of an image carrier which is placed under the exposing device RS is rotated in the direction of the arrow Ya. The surface of the photosensitive member drum PR is charged by a charging roll CR which is an example of a charger, in a charging region Q0, and then exposure-scanned by a laser beam L which is emitted from the exposing device RS, and which is an example of latent-image writing light, in a latent image writing position, thereby forming an electrostatic latent image. The surface of the photosensitive member drum PR in which the electrostatic latent image is formed is rotated to be sequentially passed through a developing region Q2 which is an example of the developing position, and a transferring region Q3 which is an example of an image recording region.

In a developing device G which develops the electrostatic latent image in the developing region Q2, a developer containing a toner and a carrier is conveyed to the developing region Q2 by developing rolls Ga, Gb that are examples of a developer carrier, and the electrostatic latent image which is passed through the developing region Q2 is developed as a toner image which is an example of an image. The toner image on the surface of the photosensitive member drum PR is conveyed to the transferring region Q3.

A transfer unit TU which is placed opposedly to the photosensitive member drum PR in the transferring region Q3, and which is an example of a transferring and transporting device has a transfer belt TB which is an example of an endless belt-like medium transporting member. The transfer belt TB is rotatably supported by a belt support roll Rd+Rf which is an example of a medium transporting member support system, and which has a driving roll Rd which is an example of a driving member, and a driven roll Rf which is an example of a driven member. A transfer roll TR which is opposed to the photosensitive member drum PR, and which is an example of a transferring device is placed across the transfer belt TB. A separation claw SC which is an example of a medium separating member is placed opposedly to the driving roll Rd, and a belt cleaner CLb which is an example of a cleaner for transfer is placed on the downstream side of the separation claw SC in the rotation direction of the transfer belt TB.

The transfer roll TR is a member for transferring the toner image on the surface of the photosensitive member drum PR to a sheet S which is an example of a medium. A transfer voltage which has a polarity opposite to the charging polarity of the developing toner used in the developing device G is supplied from a power supply circuit E to the roll. The power supply circuit E is controlled by the controller C which is an example of a controlling portion.

The sheets S which are loaded in each of sheet supply trays TR1 to TR4 which are examples of a medium loading portion are taken out by a pickup roll Rp which is an example of a medium taking out member, separated to individual sheets by a separation roll Rs which is an example of a medium separating member, and then transported to a pre-registration roll Rpr which is an example of an upstream medium transporting member, by feed rolls Ra that are examples of a plural medium transporting members. The sheet S is transported by the pre-registration roll Rpr to a registration roll Rr which is an example of a timing adjusting member which adjusts the timing of transporting the sheet S in synchronization with the timing when the toner image on the surface of the photosensitive member drum PR is moved to the transferring region Q3.

The sheet S which is transported to the registration roll Rr is transported from a pre-transfer sheet guide SG1 which is an example of a pre-transfer medium guiding member, to the transfer belt TB of the transfer unit TU in synchronization with the timing when the toner image on the photosensitive member drum PR is moved to the transferring region Q3. The transfer belt TB transports the transported sheet S to the transferring region Q3.

In the transferring region Q3, the toner image which is developed on the surface of the photosensitive member drum PR is transferred to the sheet S by the transfer roll TR. After the transfer, residual toners are removed from the surface of the photosensitive member drum PR by a photosensitive member cleaner CLp which is an example of an image carrier cleaner, and then the surface of the photosensitive member drum is recharged by the charging roll CR.

The sheet S to which the toner image is transferred by the transfer roll TR in the transferring region Q3 is separated from the surface of the transfer belt TB by the separation claw SC in the downstream from the transferring region Q3. The toner image on the separated sheet S is thermally fixed in a fixing device F having a heating roll Fh which is an example of a thermal fixing member, and a pressurizing roll Fp which is an example of a pressurizing and fixing member. Then, the sheet is passed through a mylar gate MG which is configured by an elastic sheet, and which is an example of a transporting path switching member, and transported to a feed roll Rb of a sheet discharge path SH2 which is an example of a medium discharge path. The feed roll can be rotated forwardly and reversely. The mylar gate MG is elastically deformed so that the sheet S which is passed through the fixing device F is directed toward the sheet discharge path SH2.

The sheet S which is to be discharged to a sheet discharge tray TRh which is an example of a medium discharging portion is transported through the sheet discharge path SH2 in which the feed roll Rb that can be rotated forwardly and reversely, and the plurality of feed rolls Ra are disposed. A switching gate GT1 which is an example of the transporting path switching member is placed in a downstream end portion of the sheet discharge path SH2. In the case where a post processing apparatus (not shown) is connected to the copier U, the switching gate GT1 is switched so that the transported sheet S is discharged to one of the sheet discharge tray TRh and the post processing apparatus (not shown). In a state where the post processing apparatus is not connected, the switching gate GT1 is switched so that the sheet S which is transported to the downstream end portion of the sheet discharge path SH2 is discharged to the sheet discharge tray TRh, and the sheet S is discharged to the sheet discharge tray TRh by a sheet discharge roll Rh which is an example of a medium discharging member.

In the case where duplex printing is to be performed, when the sheet S in which a printing process has been performed on one side is transported, the feed roll Rb that can be rotated forwardly and reversely is reversely rotated immediately before the rear end of the one-side printed sheet S is passed through the feed roll Rb. Therefore, the one-side printed sheet S is returned toward the mylar gate MG or switched back, through the sheet discharge path SH2. The mylar gate MG causes the sheet S which is switched back by the feed roll Rb, to be directed toward a sheet circulating transporting path SH3 which is an example of a medium circulating transporting path. The one-side printed sheet S which is transported into the sheet circulating transporting path SH3 is resent to the transferring region Q3 in a state where the sheet is reversed. The one-side printed sheet S which is resent to the transferring region Q3 is subjected to a process of transferring a toner image to the second face, and then transported through the sheet discharge path SH2 to be discharged onto the sheet discharge tray TRh.

(Description of Developing Device)

Figure 2A:
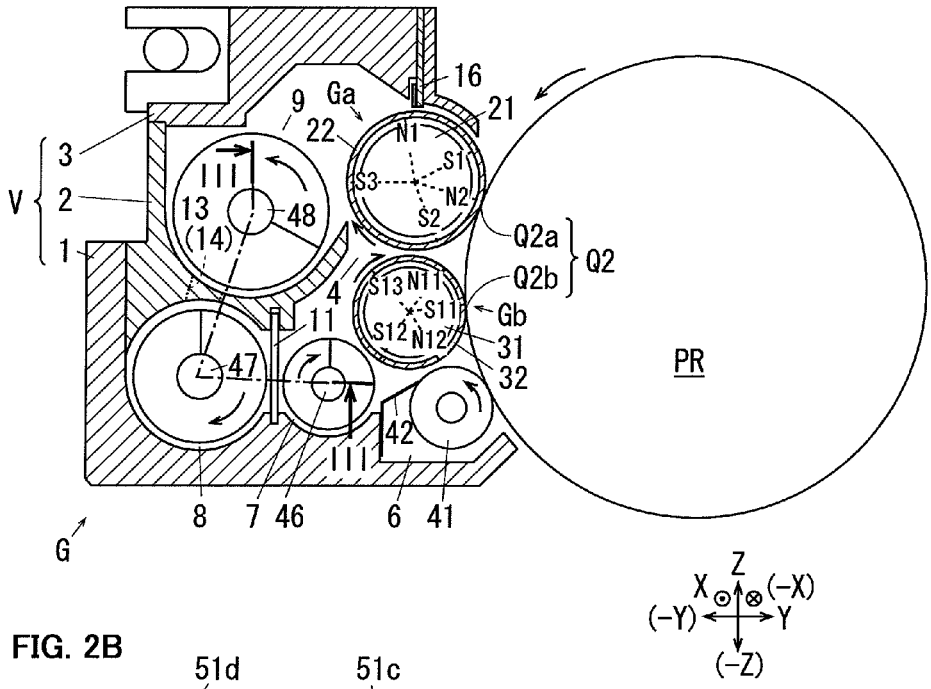
FIGS. 2A and 2B are diagrams of a developing device of Example 1.
Figure 2B:
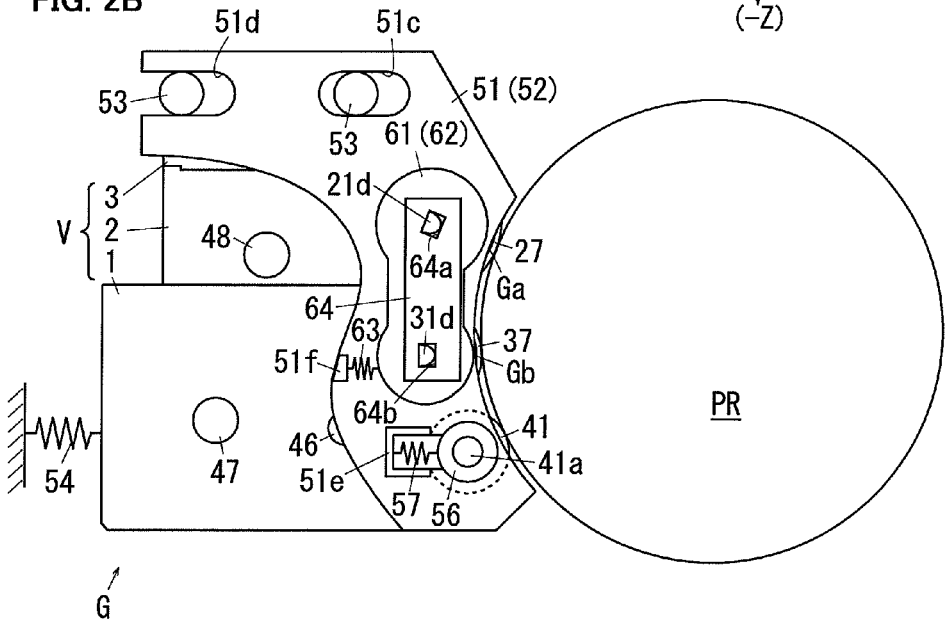

FIGS. 2A and 2B are diagrams of the developing device of Example 1, FIG. 2A is a sectional view of main portions, and FIG. 2B is a side view as viewing the developing device from the front side.

Referring to FIGS. 2A and 2B, the developing device G of Example 1 has a developing housing V in which the developer is contained. The developing housing V in Example 1 has a bottom portion 1, a partition portion 2 which is supported on the bottom portion 1, and a cover portion 3 which is supported on the partition portion 2. Referring to FIG. 2A, in the developing housing V, a developing roll chamber 4 which is an example of a carrier containing portion is formed at a position opposed to the photosensitive member PR. Below the developing roll chamber 4, a recovery roll chamber 6 which is an example of a recovery member containing portion is formed in the bottom portion 1 on the side of the photosensitive member PR.

Figure 3:
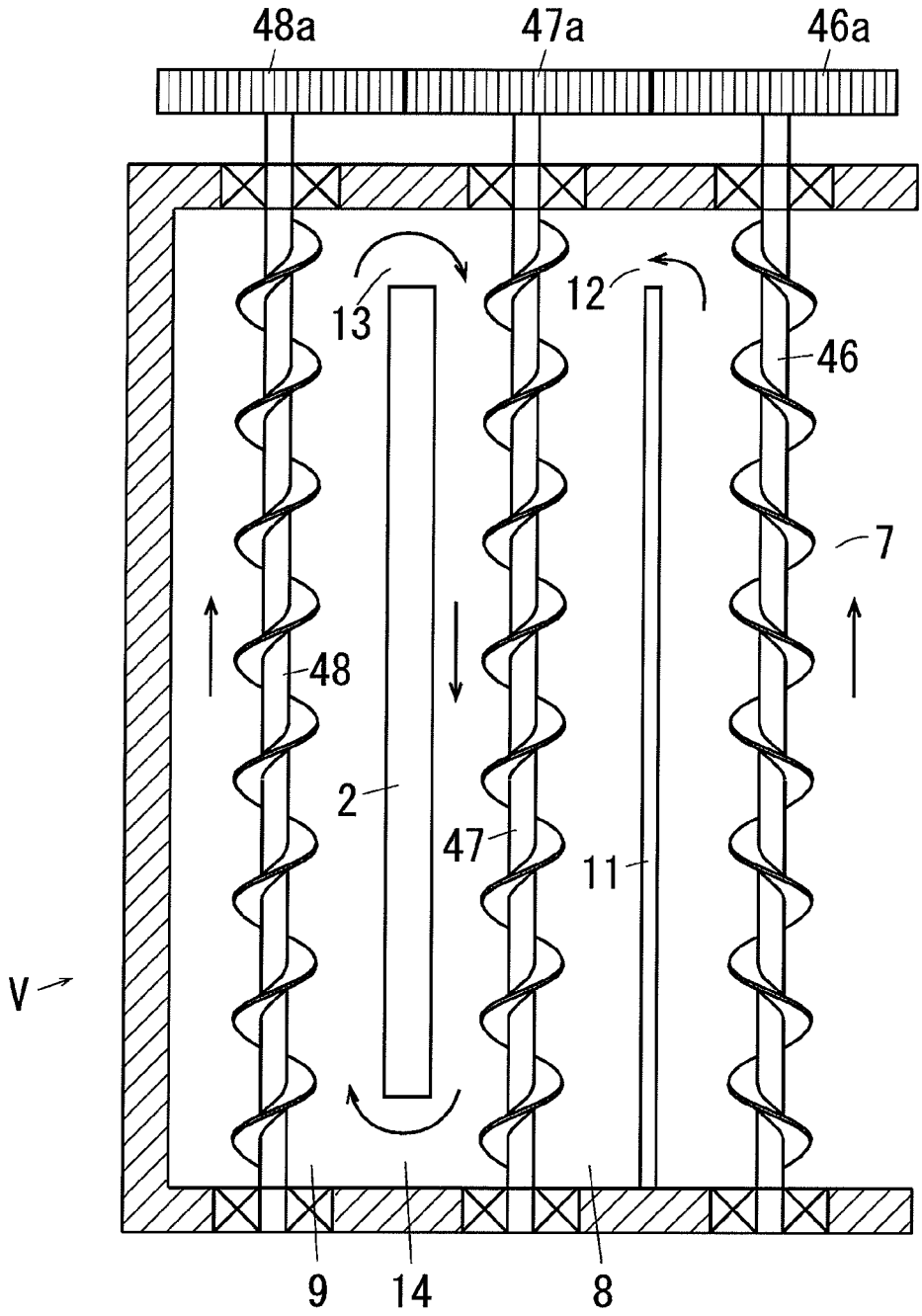
FIG. 3 is a diagram of a transporting member of the developing device of Example 1, and a sectional view taken along line III-III in FIG. 2A.

FIG. 3 is a diagram of a transporting member of the developing device of Example 1, and a sectional view taken along line III-III in FIG. 2A.

Referring to FIGS. 2A and 3, on the obliquely left lower side of the developing roll chamber 4, a first stirring chamber 7 which is an example of a first stirring portion, and which extends in the front and rear directions is formed between the bottom portion 1 and the partition portion 2. On the left side of the first stirring chamber 7, a second stirring chamber 8 which is an example of a second stirring portion, and which extends in the front and rear directions is formed between the bottom portion 1 and the partition portion 2. On the obliquely right upper side of the second stirring chamber 8, a third stirring chamber 9 is formed between the partition portion 2 and the cover portion 3.

As shown in FIGS. 2A and 3, the lower portion of the developing roll chamber 4 communicates with the first stirring chamber 7, and the upper portion of the developing roll chamber 4 communicates with the third stirring chamber 9, so that the developer can be moved. The space between the first stirring chamber 7 and the second stirring chamber 8 is partitioned in the range from the front end to the rear portion by a partitioning member 11 which is supported between the bottom portion 1 and the partition portion 2, and a first flow portion 12 into which the developer can flow in is formed in the rear end of the partitioning member 11. The second stirring chamber 8 and the third stirring chamber 9 communicate with each other by a second flow portion 13 formed in the rear end of the partition portion 2, and a third flow portion 14 formed in the front end, so that the developer can be moved.

Referring to FIG. 2A, the first developing roll Ga which is an example of a first developer carrier is housed in the upper portion of the developing roll chamber 4, and the second developing roll Gb which is an example of a second developer carrier is housed below the first developing roll Ga. Therefore, the second developing roll Gb is placed in the downstream of the first developing roll Ga in the rotation direction of the photosensitive member PR. Above the first developing roll Ga, a trimmer 16 which is an example of a layer thickness restricting member, which is opposed to the first developing roll Ga, and which restricts the thickness of the layer of the developer held to the surface of the first developing roll Ga is supported on the right end of the cover portion 3.

Figure 4:
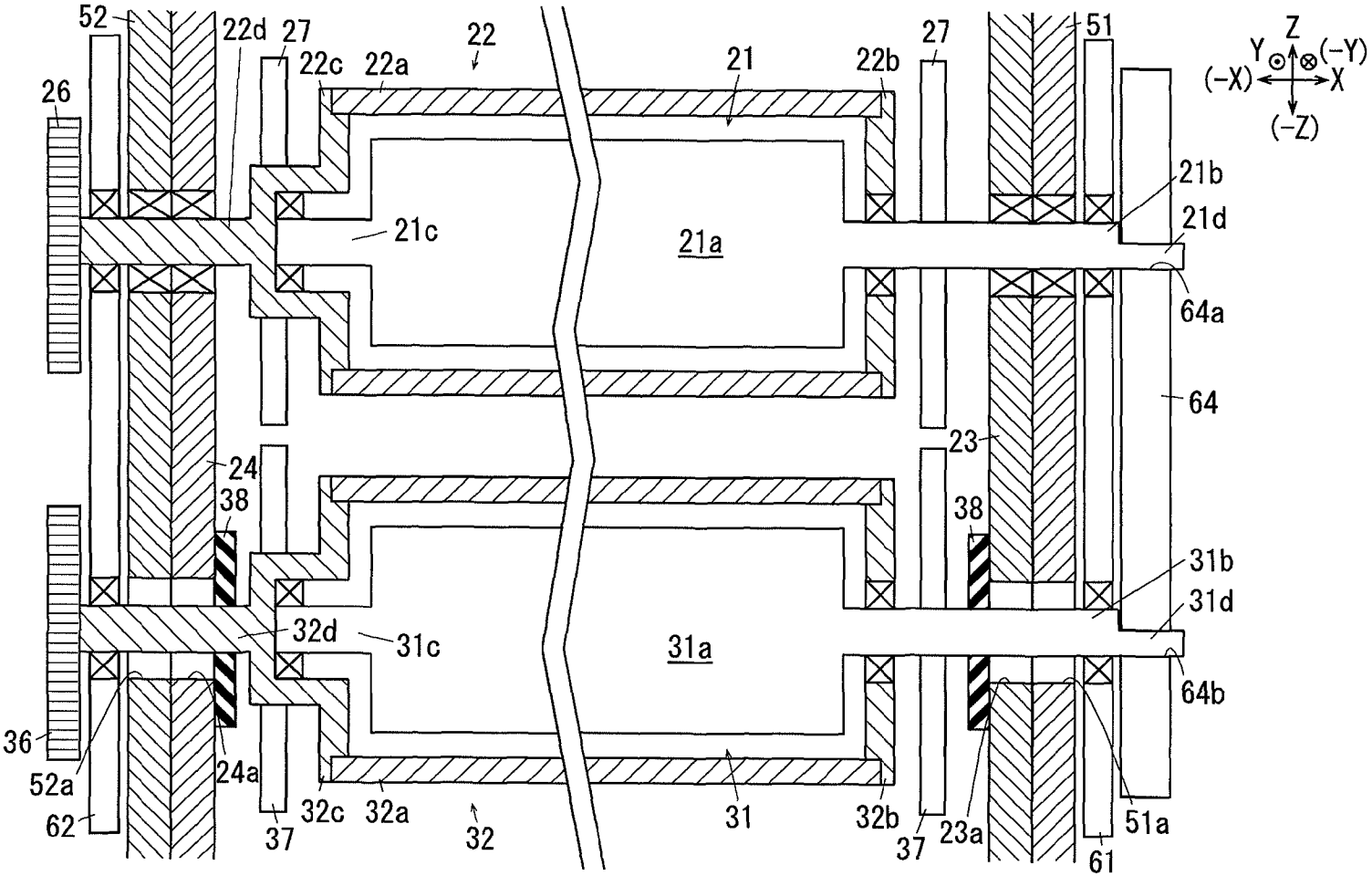
FIG. 4 is a diagram of main portions of developing rolls in Example 1.

FIG. 4 is a diagram of main portions of the developing rolls in Example 1.

Referring to FIG. 2A, the first developing roll Ga has: a first magnet roll 21 which is an example of a first magnet member; and a first developing sleeve 22 which is placed so as to surround the outer circumference of the first magnet roll 21, which is rotatable, and which is an example of a first holding rotary member.

Referring to FIG. 4, the first magnet roll 21 has a first magnet body 21*a* which has a columnar shape, and first fixed shafts 21*b*, 21*c* which extend respectively in the front and rear directions from the first magnet body 21*a*. The front first fixed shaft 21*b* is rotatably supported by the front wall 23 of the developing housing V, and forwardly projected. A first fixed portion 21*d* which is formed into a partially removed circular section shape, or a so-called D-cut shape is formed in the front end of the shaft.

The first developing sleeve 22 has: a cylindrical sleeve body 22*a* which is an example of a rotary member body; and first hubs 22*b*, 22*c* which are supported respectively by the front and rear ends of the sleeve body 22*a*, and which are examples of a shaft short member. The front first hub 22*b* is rotatably supported by the front first fixed shaft 21*b*. The rear first hub 22*c* rotatably supports the first fixed shaft 21*c* by the inner circumferential face of the middle portion, and has a first rotary shaft 22*d* which rearwardly extends. The first rotary shaft 22*d* is rotatably supported by the rear wall 24 of the developing housing V, and rearwardly projected. A first developing gear 26 which is an example of a first gear is supported by the rear end of the first rotary shaft 22*d*.

A first tracking roll 27 which is an example of a first interval setting member, and in which the diameter is larger than the outer diameter of the developing sleeve body 22*a* is rotatably supported by the front first fixed shaft 21*b* and the rear first hub 22*c*.

Referring to FIG. 2A, the first magnet body 21*a* has a first developing magnetic pole N2 corresponding to a first developing region Q2*a* which is an example of a first developing position opposed to the photosensitive member PR. A first conveying magnet pole S1 which holds the developer to the surface of the first developing sleeve 22 is placed on the upstream side of the first developing magnetic pole N2 in the rotation direction of the first developing sleeve 22. A first trimming magnetic pole N1 which is an example of a first layer thickness restricting pole, and which corresponds to the trimmer 16 is placed on the upstream side of the first conveying magnet pole S1. A first pickup magnetic pole S3 which is an example of a first attracting magnet pole, and which causes the developer in the third stirring chamber 9 to be attracted to the first developing sleeve 22 by a magnetic force is placed on the upstream side of the first trimming magnetic pole N1. A first pick off magnetic pole S2 which is an example of a first escaping magnetic pole, and which causes the developer to escape from the first developing sleeve 22 is placed on the upstream side of the first pickup magnetic pole S3 and on the downstream side of the developing magnetic pole N2.

Referring to FIG. 2A, the second developing roll Gb is configured in the same manner as the first developing roll Ga, and has: a second magnet roll 31 which is an example of a second magnet member; and a second developing sleeve 32 which is placed so as to surround the outer circumference of the second magnet roll 31, which is rotatable, and which is an example of a second holding rotary member.

Referring to FIG. 4, the second magnet roll 31 has a second magnet body 31*a* which has a columnar shape, and second fixed shafts 31*b*, 31*c* which extend respectively in the front and rear directions from the second magnet body 31*a*. The front second fixed shaft 31*b* is forwardly projected while being passed through a front through port 23*a* which is formed in the front wall 23 of the developing housing V, and in which the diameter is larger than the second fixed shaft 31*b*. Namely, the second fixed shaft 31*b* is passed through the front through port 23*a* in a state where a gap is formed, or a so-called play is formed. The second fixed shaft 31*b* is in a state where it is movable with respect to the developing housing V.

A second fixed portion 31*d* which is formed into a partially removed circular section shape, or a so-called D-cut shape is formed in the front end of the front second fixed shaft 31*b*.

In a similar manner as the first developing sleeve 22, the second developing sleeve 32 has: a cylindrical sleeve body 32*a;* and second hubs 32*b*, 32*c* which are supported respectively by the front and rear ends of the sleeve body 32*a*. The front second hub 32*b* is rotatably supported by the front second fixed shaft 31*b*. The rear second hub 32*c* rotatably supports the second fixed shaft 31*c* by the inner circumferential face of the middle portion, and has a second rotary shaft 32*d* which rearwardly extends. The second rotary shaft 32*d* is rearwardly projected while being passed through a rear through port 24*a* which is formed in the rear wall 24 of the developing housing V, and in which the diameter is larger than the second rotary shaft 32*d*. Namely, the second rotary shaft 32*d* is passed through the rear through port 24*a* in a state where a gap is formed, or a so-called play is formed. The second rotary shaft 32*d* is in a state where it is movable with respect to the developing housing V.

A second developing gear 36 which is an example of a second gear is supported by the rear end of the second rotary shaft 32*d*.

A second tracking roll 37 which is an example of a second interval setting member, and in which the diameter is larger than the outer diameter of the developing sleeve body 32*a* is rotatably supported by the front second fixed shaft 31*b* and the rear second hub 32*c*.

On the front second fixed shaft 31*b* and the second rotary shaft 32*d*, in order to prevent the developer from leaking from the through ports 23*a*, 24*a*, sponge-made seals 38 that are examples of a scatter preventing member are supported by the inner circumferential faces of the front wall 23 and the rear wall 24, respectively.

Referring to FIG. 4, driving of a driving source which is disposed in the apparatus body U1, and which is not shown is transmitted to the first developing gear 26 and the second developing gear 36, and the first developing sleeve 22 and the second developing sleeve 32 are rotated in the developing regions Q2*a*, Q2*b* in the same direction as the surface of the photosensitive member PR.

Referring to FIG. 2A, the second magnet roll 31 has a second developing magnetic pole S11 corresponding to a second developing region Q2*b* which is an example of a second developing position opposed to the photosensitive member PR. A second pickup magnetic pole N11 which is an example of a second attracting magnet pole, and which causes the developer separating from the first developing roll to be attracted to the second developing sleeve 32 is placed on the upstream side of the second trimming magnetic pole S1. A second conveying magnet pole N12 which holds the developer to the surface of the second developing sleeve 32 is placed on the downstream side of the second developing magnetic pole S11. On the downstream side of the second conveying magnet pole N12, second pickup magnetic poles S12, S13 which cause the developer to be separated from the second developing sleeve 32 and drop into the first stirring chamber 7 are sequentially placed along the rotation direction of the second developing sleeve 32.

In the recovery roll chamber 6, a recovery roll 41 which is an example of a developer recovery member is placed oppositely to the photosensitive member PR. The recovery roll 41 to which driving is transmitted through a gear (not shown) is rotated to recover a carrier which adheres to the surface of the photosensitive member PR and toners which excessively adhere to the surface, in the developing region Q2.

A scraper 42 which is an example of a scraping-off member, and which is contacted with the surface of the recovery roll 41 to scrape off the toners and the like that are recovered by the recovery roll 41 is supported in the boundary between the recovery roll chamber 6 and the first stirring chamber 7. The toners and the like which are scraped off by the scraper 42 are moved to the first stirring chamber 7.

Referring to FIGS. 2A and 3, a first auger 46 which is an example of a first stirring member, and which extends in the front and rear directions is housed in the first stirring chamber 7. A first stirring gear 46*a* which is an example of a first stirring gear is supported by the rear end of the first auger 46 so that driving of the driving source which is disposed in the apparatus body U1, and which is not shown is transmitted to the gear. When rotated, the first auger 46 in Example 1 conveys the developer in in the first stirring chamber 7 from the front side to the first flow portion 12 which is located in the rear side.

A second auger 47 which is an example of a second stirring member, and which extends in the front and rear directions is housed in the second stirring chamber 8. A second stirring gear 47*a* which is an example of a second stirring gear is supported by the rear end of the second auger 47 so that driving of the driving source which is disposed in the apparatus body U1, and which is not shown is transmitted to the gear. When rotated, the second auger 47 in Example 1 conveys the developer in the second stirring chamber 8 from the third flow portion 14 which is located in the front side to the second flow portion 13 which is located in the rear side.

A third auger 48 which is an example of a third stirring member, and which extends in the front and rear directions is housed in the third stirring chamber 9. A third stirring gear 48*a* which is an example of a third stirring gear is supported by the rear end of the third auger 48 so that driving of the driving source which is disposed in the apparatus body U1, and which is not shown is transmitted to the gear. When rotated, the third auger 48 in Example 1 conveys the developer in the third stirring chamber 9 from the second flow portion 13 which is located in the rear side to the third flow portion 14 which is located in the front side.

In the developing device G of Example 1, therefore, the developer which is recovered by the recovery roll 41 is conveyed to the first flow portion 12 while being stirred by the first auger 46, and then conveyed to the second stirring chamber 8. The developer of the third stirring chamber 9 is rearwardly conveyed while being stirred by the third auger 48, and then supplied to the first developing roll Ga. The developer which is conveyed to the second flow portion 13 drops to flow into the second stirring chamber 8 which is located in the lower side. The developer of the second stirring chamber is forwardly conveyed while being stirred by the second auger 47, and, in the third flow portion 14, then sucked up into the third stirring chamber 9. In Example 1, therefore, a circulating and conveying chamber 8+9 is configured by the second stirring chamber 8 and the third stirring chamber 9, and a circulating and conveying member 47+48 is configured by the second auger 47 and the third auger 48.

(Description of Positioning Mechanism of Developing Device)

Referring to FIGS. 2A and 4, a pair of front and rear side plates 51, 52 that are examples of a sidewall member are supported by the front face of the front wall 23 of the developing housing V and the rear face of the rear wall 24, respectively. In the same manner as the front and rear walls 23, 24, as shown in FIG. 4, the side plates 51, 52 rotatably support the front first fixed shaft 21*b* and first rotary shaft 22*d* of the first developing roll Ga, and support the front second fixed shaft 31*b* and the rear second rotary shaft 32*d* in a movable state by through ports 51*a*, 52*a* through which the shafts are passed, respectively.

The side plates 51, 52 are configured in the same manner. Therefore, the front side plate 51 will be described in detail, and the description of the rear side plate 52 will be omitted.

Referring to FIG. 2B, in the side plate 51, a guide long hole 51*c* which is an example of a guiding portion, and which extends in the right and left directions is formed in a middle portion of an upper end portion. A guide groove 51*d* which is an example of the guide member, which is paired with the guide long hole 51*c*, and which extends in the right and left directions is formed in the left end of the upper end portion of the side plate 51. Guide pins 53 which are examples of a guided portion, and which extend from the apparatus body U1 are fitted into the guide long hole 51*c* and the guide groove 51*d*, respectively, so that the developing device G is supported so as to be movable in directions along which the device approaches and separates from the photosensitive member PR.

As shown in FIG. 2B, the developing device G of Example 1 is pushed in a lower portion of the left face toward the photosensitive member PR by a develop spring 54 which is attached between the device and the apparatus body U1, and which is an example of a pushing member.

A recovery spring mount 51*e* which is an example of an urge supporting member is formed in a lower end portion of the side plate 51. A bearing 56 which rotatably supports a rotary shaft 41*a* of the recovery roll 41 is placed in the recovery spring mount 51*e* on the side of the photosensitive member PR. A spring 57 which is an example of the pushing member is attached between the bearing 56 and the recovery spring mount 51*e*, thereby pushing the recovery roll 41 toward the photosensitive member PR.

Referring to FIG. 2B, in a middle portion of the side plate 51 in the upper and lower directions, a couple spring mount 51*f* which is an example of a spring mount is formed on the left side of the second fixed shaft 31*b*.

Referring to FIGS. 2B and 4, a pair of front and rear coupling plates 61, 62 that are examples of a coupling member are supported by the outer sides of the side plates 51, 52 in the front and rear directions, respectively. The coupling plates 61, 62 rotatably support the first fixed shaft 21*b* and first rotary shaft 22*d* of the first developing roll Ga, and the second fixed shaft 31*b* and second rotary shaft 32*d* of the second developing roll Gb. Therefore, the both ends of the second developing roll Gb which is movable with respect to the front wall 23, the rear wall 24, and the side plates 51, 52 are supported by the coupling plates 61, 62. The coupling plates 61, 62 are in a state where the plates are rotatable about the first fixed shaft 21*b* and first rotary shaft 22*d* of the first developing roll Ga, or a so-called swingable state.

Couple springs 63 are attached between the couple spring mount 51*f* and the lower end portions of the coupling plates 61, 62 to urge the lower ends of the coupling plates 61, 62, i.e., the second developing roll Gb in the direction along which the roll approaches the photosensitive member PR.

A magnetic pole setting plate 64 which is an example of a magnetic pole fixing member is placed in front of the front side plate 51. In the magnetic pole setting plate 64, a first fixing hole 64*a* into which the first fixed portion 21*d* having a D-cut shape is fitted, and which unrotatably supports the first magnet roll 21 is formed at a position corresponding to the first fixed shaft 21*b* of the first developing roll Ga. A second fixing hole 64*b* into which the second fixed portion 31*d* having a D-cut shape is fitted, and which unrotatably supports the second magnet roll 31 is formed at a position corresponding to the second fixed shaft 31*b* of the second developing roll Gb under the first fixing hole 64*a*.

In the thus-configured copier U of Example 1, the guide long hole 51*c* and guide groove 51*d* of the developing device G are fitted onto the guide pins 53 of the apparatus body U1, and the developing device G that is movable in directions along which the device approaches and separates from the photosensitive member PR is pushed by the develop spring 54 toward the photosensitive member PR. Therefore, the tracking rolls 27, 37 of the developing rolls Ga, Gb are contacted with end portions of the photosensitive member PR, and the gaps between the developing sleeves 22, 32 and the surface of the photosensitive member PR are held to the distance of the difference between the outer diameters of the tracking rolls 27, 37 and those of the developing sleeves 22, 32. Also the recovery roll 41 is held by the spring 57 to a state where the sleeves are not contacted with the photosensitive member PR, through a tracking roll which is not shown.

Figures 5A, 5B, 5C:
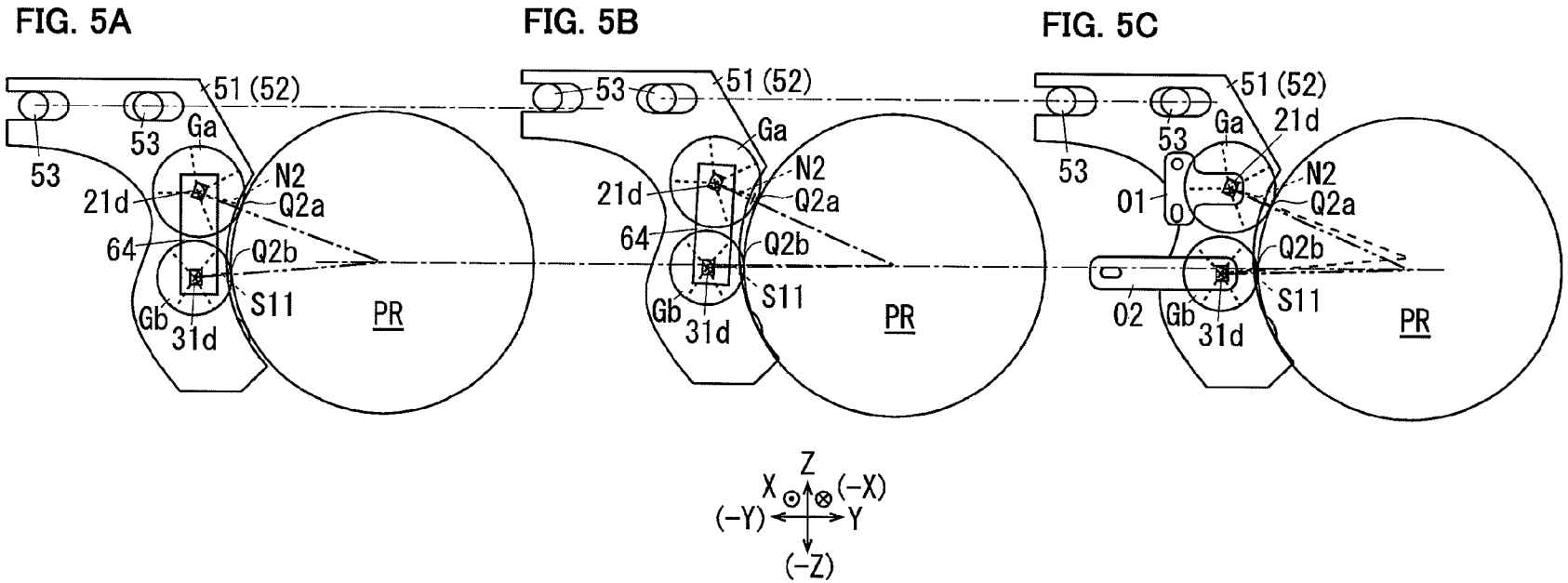
FIGS. 5A, 5B and 5C are diagrams of positional relationships between a photosensitive member and the developing device.

FIGS. 5A to 5C are diagrams of positional relationships between the photosensitive member and the developing device, FIG. 5A is a diagram of a state which is a design objective, FIG. 5B is a diagram of a state in which the configuration of Example 1 is employed and the developing device is upwardly deviated from the state of FIG. 5A, and FIG. 5C is a diagram of a state in which, in the conventional configuration, the developing device is upwardly deviated from the state of FIG. 5A.

Figure 6A:
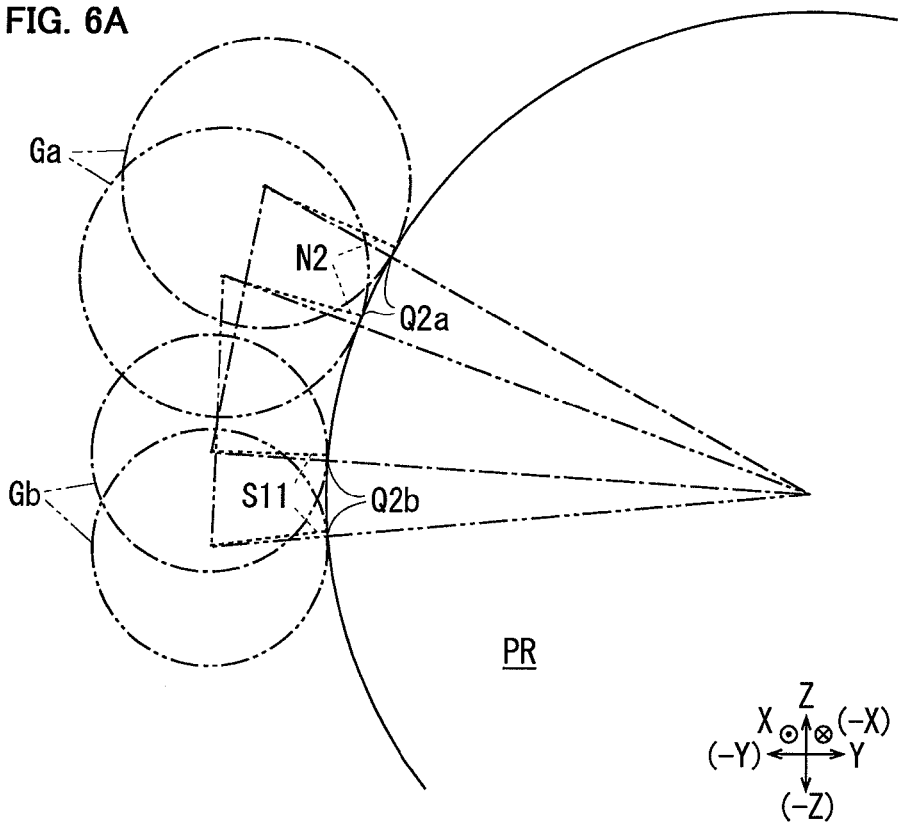
FIGS. 6A and 6B are diagrams of positional relationships between the center of the photosensitive member and the magnetic poles of the developing rolls.
Figure 6B:
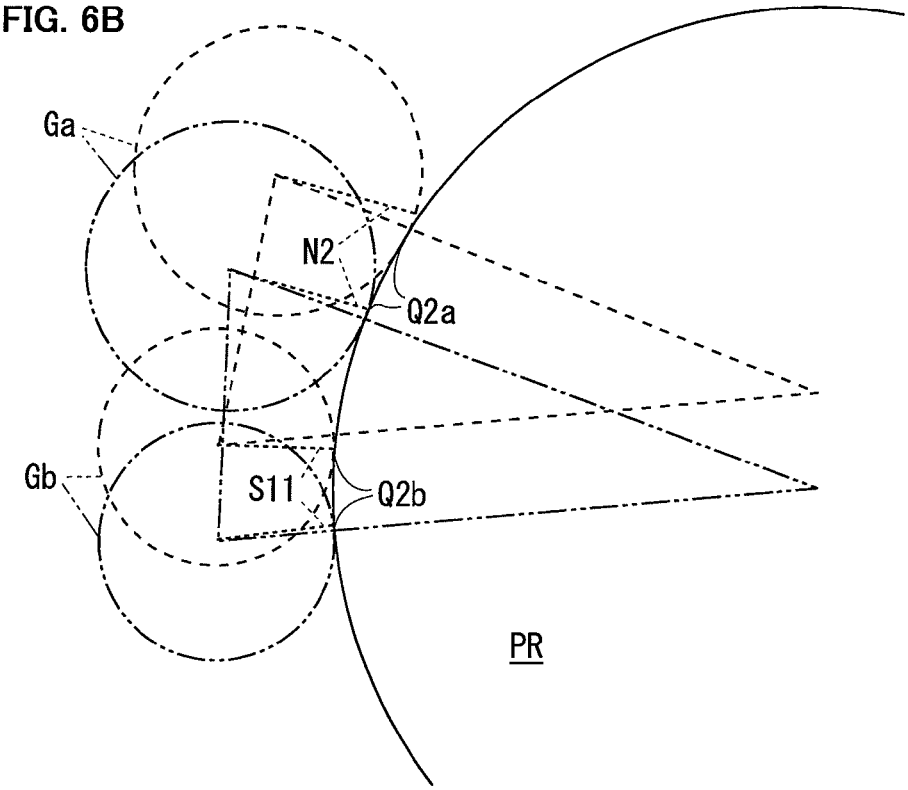

FIGS. 6A and 6B are diagrams of positional relationships between the center of the photosensitive member and the magnetic poles of the developing rolls, FIG. 6A is a diagram of positional relationships corresponding to FIGS. 5A and 5B, and FIG. 6B is a diagram of positional relationships corresponding to FIGS. 5A and 5C.

Referring to FIGS. 5A and 6A, when the developing device G of Example 1 is supported by the apparatus body U1 at a position which is preset in the design or the like, the tracking roll 27 of the first developing roll Ga is contacted with the photosensitive member PR, and the first developing sleeve 22 and the photosensitive member PR are separated from each other by a preset gap in the first developing region Q2*a*. The second developing roll Gb is pushed by the couple springs 63 toward the photosensitive member PR, the tracking roll 37 is contacted therewith, and, in the second developing region Q2*b*, the second developing sleeve 32 and the photosensitive member PR are separated from each other by a preset gap.

At this time, the positions of the magnetic poles of the first magnet roll 21 and the second magnet roll 31 are held and fixed by the magnetic pole setting plate 64, and, as indicated by the two-dot chain lines in FIGS. 6A and 6B, the positional relationships between the developing magnetic poles N2, S11 with respect to the developing regions Q2*a*, Q2*b* are held to preset states.

Referring to FIGS. 5A to 5C, 6A, and 6B, in accordance with, for example, production, assembly, and accumulated errors of components of the developing device G, assembly errors of the guide pins 53, and the like of the apparatus body U1, the position of the developing device G may be deviated from an objective position which is preset.

In the conventional configuration shown in FIG. 5C, in the case where the two developing rolls Ga, Gb are disposed, the magnet rolls 21, 31 are fixed by separate fixing members O1, O2, respectively. When the position of the developing device G is deviated from the objective position, therefore, the positions of the developing regions Q2*a*, Q2*b* where the developing rolls Ga, Gb are opposed to the photosensitive member drum PR, and the magnetic poles are largely deviated from the objective positions as indicated by the broken lines in FIGS. 5C and 6B. Therefore, also the interval between the developing regions Q2*a*, Q2*b*, and the positions of the magnetic poles in the developing regions Q2*a*, Q2*b* are deviated, and the developing conditions are changed, thereby causing a possibility that a developing failure may occur.

In the configuration of Example 1 shown in FIG. 5B, by contrast, the second developing roll Gb is movable or can be freely moved with respect to the developing housing V, and supported by the coupling plates 61, 62 which are rotatable or swingable about the shafts 21*b*, 22*d* of the first developing roll Ga. Therefore, the second developing roll is swung in the state where the interval between the first developing roll Ga and the second developing roll Gb is held to the preset one. Even when the position of the developing device G is deviated, consequently, the second developing roll Gb is swung to be moved so that the second developing region Q2*b* follows the change of the first developing region Q2*a*, in the circumferential direction of the photosensitive member drum PR. Therefore, the interval between the first developing region Q2*a* and the second developing region Q2*b* in the circumferential direction of the photosensitive member drum PR can be easily held.

If the interval between the first developing region Q2*a* and the second developing region Q2*b* is changed, the attenuation of the surface potential of the photosensitive member drum PR during a period when the surface of the photosensitive member drum PR is moved from the first developing region Q2*a* to the second developing region Q2*b* is changed, the developing conditions are changed, and an adverse influence is exerted on the image. In Example 1, by contrast, the interval between the first developing region Q2*a* and the second developing region Q2*b* can be easily held as compared with the configuration shown in FIG. 5C, and hence a developing failure and adverse influence on an image due to a change of the developing conditions are reduced.

In the developing device G of Example 1, the first fixed shaft 21*b* of the first developing roll Ga and the second fixed shaft 31*b* of the second developing roll Gb are unrotatably fixed by one magnetic pole setting plate 64. Even when the position of the developing device G of Example 1 is deviated, therefore, the second developing roll Gb is swung to be moved along the circumferential face of the photosensitive member PR, and the positional relationships between the first developing roll Ga and the second developing roll Gb are held. At this time, the fixed shafts 21*b*, 31*b* are rotatably supported by the coupling plates 61, 62, and, in accordance with the swing of the second developing roll Gb, also the magnetic pole setting plate 64 to which the fixed shafts 21*b*, 31*b* are fixed is rotated. Therefore, also the magnet rolls 21, 31 are rotated, and, as indicated by the dash-dot lines in FIGS. 5B and 6A, also the positions of the magnetic poles, i.e., those of the developing magnetic poles N2, S11 are rotated.

In accordance with the positional deviation of the developing device G, therefore, also the positions of the magnetic poles of the two developing rolls Ga, Gb are interlockingly moved, and the positional relationships between the developing magnetic poles N2, S11 and the developing regions Q2*a*, Q2*b* in the pre-deviation state are substantially identical with those in the post-deviation state. Even when positional deviation occurs in the developing device G, therefore, deviation of the positional relationships between the developing magnetic poles N2, S11 and the developing regions Q2*a*, Q2*b* is suppressed, and the positional accuracy of the magnetic poles is improved. Consequently, changes of the developing conditions are reduced, and occurrence of a developing failure is reduced.

(Modifications)

Although the example of the invention has been described in detail, the invention is not restricted to the example. Various modifications are enabled within the scope of the gist of the invention set forth in the claims. Modifications (H01) to (H014) of the invention will be exemplified.

(H01) Although, in the example, the copier U has been described as an example of the image forming apparatus, the invention is not restricted to this. The invention may be applied to a printer, a facsimile apparatus, a multi-function apparatus having a plurality of functions of these apparatuses, or the like. The invention is not restricted to an image forming apparatus of the monochromatic development system, and may be configured by a multi-color or so-called color image forming apparatus.

(H02) Although, in the example, the case where the two developing rolls Ga, Gb are used has been exemplified. The number of the developing rolls is not restricted to two. Alternatively, three or more developing rolls may be disposed. In the alternative, preferably, also the third and subsequent developing rolls are provided with a swinging configuration, or a configuration in which the rolls are coupled to the second developing roll by a magnetic pole fixing member such as a magnetic pole setting plate.

(H03) Although the example is configured so that the second developing roll Gb is swung about the first developing roll Ga, and also the magnetic pole setting plate 64 is rotated about the first fixed shaft 21*b*, the invention is not restricted to this configuration, and a configuration where two rolls and magnetic pole setting plates can be interlockingly swung about a position intermediate between the two rolls may be possible. The invention is not restricted to the configuration where the rotation is performed about the rotation center. An arbitrary moving mechanism such as that in which slide movement is performed in the approaching and separating directions with respect to the photosensitive member PR may be employed.

(H04) Although, in the example, the second developing roll Gb on the downstream side is swung. Alternatively, the first developing roll Ga on the upstream side may be swung.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A developing device comprising:

a developing housing in which a developer is to be contained;

a first developer carrier that is placed opposedly to an image carrier which is rotated while a latent image is formed on a surface of the image carrier, that is supported by the developing housing, and that is rotated while holding the developer on a surface of the first developer carrier;

a second developer carrier that is supported movably with respect to the developing housing, that is opposed to the image carrier on an upstream or downstream side of the first developer carrier in a rotation direction of the image carrier, and that is rotated while holding the developer on a surface of the second developer carrier;

a coupling member that couples the first developer carrier with the second developer carrier, and that supports the second developer carrier in a rotatable manner with respect to the first developer carrier; and a stirring portion which is provided at an obliquely downward side of one of the first and second developer carriers which is provided at a downstream side of the other of the first and second developer carriers in a rotation direction of the image carrier;

wherein:

the first developer carrier comprises: a first magnet member having a plurality of magnetic poles; and a first holding rotary member that is rotated while surrounding the first magnet member, the second developer carrier comprises: a second magnet member having a plurality of magnetic poles; and a second holding rotary member that is rotated while surrounding the second magnet member, the device further comprises a single magnetic pole fixing member that fixedly supports both the first magnet member and the second magnet member, that fixes relative positional relationships between the magnetic poles of the first magnet member and the magnetic poles of the second magnet member, and that is supported movably with respect to the developing housing in a state where the developing housing supports the first developer carrier and the second developer carrier, and the first magnet number and the second magnet member are unrotatable with respect to the magnetic pole fixing member.

2. A developing device according to claim 1 wherein, in accordance with a change of a position where the first developer carrier and the image carrier are opposed to each other, a position where the second developer carrier and the image carrier are opposed to each other follows the change in a circumferential direction of the image carrier.

3. A developing device according to claim 1 wherein an interval between a position where the first developer carrier and the image carrier are opposed to each other and a position where the second developer carrier and the image carrier are opposed to each other in a circumferential direction of the image carrier is held.

4. The developing device according to claim 1, wherein the magnetic pole fixing member unrotatably supports shaft ends of the first magnet member and the second magnet member, and is supported rotatably and movably with respect to the developing housing in a state where the developing housing supports the first developer carrier and the second developer carrier about an axis of the first magnet member that is rotatably supported by the developing housing.

5. The developing device according to claim 2, wherein the magnetic pole fixing member unrotatably supports shaft ends of the first magnet member and the second magnet member, and is supported rotatably and movably with respect to the developing housing in a state where the developing housing supports the first developer carrier and the second developer carrier about an axis of the first magnet member that is rotatably supported by the developing housing.

6. The developing device according to claim 3, wherein the magnetic pole fixing member unrotatably supports shaft ends of the first magnet member and the second magnet member, and is supported rotatably and movably with respect to the developing housing in a state where the developing housing supports the first developer carrier and the second developer carrier about an axis of the first magnet member that is rotatably supported by the developing housing.

7. An image forming apparatus comprising:

an image carrier that is rotated while a latent image is formed on a surface of the image carrier;

the developing device according to claim 1, the device developing the latent image on the surface of the image carrier, to a visible image;

a transferring device that transfers the visible image on the surface of the image carrier, to a medium; and a fixing device that fixes the visible image transferred to the medium.

8. An image forming apparatus comprising:

an image carrier that is rotated while a latent image is formed on a surface of the image carrier;

the developing device according to claim 2, the device developing the latent image on the surface of the image carrier, to a visible image;

a transferring device that transfers the visible image on the surface of the image carrier, to a medium; and a fixing device that fixes the visible image transferred to the medium.

9. An image forming apparatus comprising:

an image carrier that is rotated while a latent image is formed on a surface of the image carrier;

the developing device according to claim 3, the device developing the latent image on the surface of the image carrier, to a visible image;

a transferring device that transfers the visible image on the surface of the image carrier, to a medium; and a fixing device that fixes the visible image transferred to the medium.

10. The developing device according to claim 1, wherein the stirring portion comprises at least three stirring chambers, and wherein each of the three stirring chambers has a stirring member and at least one of the three stirring chambers is provided at an obliquely downward side of one of the first and second developer carriers which is provided at a downstream side of the other of the first and second developer carriers in a rotation direction of the image carrier.

11. The developing device according to claim 2, wherein the stirring portion comprises at least three stirring chambers, and wherein each of the three stirring chambers has a stirring member and at least one of the three stirring chambers is provided at an obliquely downward side of one of the first and second developer carriers which is provided at a downstream side of the other of the first and second developer carriers in a rotation direction of the image carrier.

12. The developing device according to claim 3, wherein the stirring portion comprises at least three stirring chambers, and wherein each of the three stirring chambers has a stirring member and at least one of the three stirring chambers is provided at an obliquely downward side of one of the first and second developer carriers which is provided at a downstream side of the other of the first and second developer carriers in a rotation direction of the image carrier.

13. The developing device of claim 10, wherein one of the three stirring portions is provided at an upper side of the other two of the three stirring portions.

14. The developing device of claim 11, wherein one of the three stirring portions is provided at an upper side of the other two of the three stirring portions.

15. The developing device of claim 12, wherein one of the three stirring portions is provided at an upper side of the other two of the three stirring portions.

16. The developing device of claim 1, further comprising a rotatable developer recovery member placed opposedly to the image carrier.

17. The developing device of claim 2, further comprising a rotatable developer recovery member placed opposedly to the image carrier.

18. The developing device of claim 3, further comprising a rotatable developer recovery member placed opposedly to the image carrier.

19. The developing device of claim 1, wherein the developing housing has through holes in a front wall of the developing housing, such that longitudinal end parts of the first developer carrier and the second developer carrier pass through the through holes and are supported, and wherein the magnetic pole fixing member supports the first magnet member and the second magnet member at a portion nearer to the longitudinal end part than the through holes.

* * * * *